US005695410A

United States Patent [19]

Brown

[11] Patent Number: 5,695,410

[45] Date of Patent: Dec. 9, 1997

[54] GOLF CLUB HEAD AND HOSEL

[76] Inventor: Joel B. Brown, 4540 Smithville Rd., Jacksonville, Fla. 32210

[21] Appl. No.: 629,585

[22] Filed: Apr. 9, 1996

[51] Int. Cl.[6] ..... A63B 53/02

[52] U.S. Cl. ..... 473/305; 473/314

[58] Field of Search ..... 473/305–315, 473/324, 288, 289, 290

[56] References Cited

U.S. PATENT DOCUMENTS

| | | | |
|---|---|---|---|
| D. 235,272 | 6/1975 | Quast | 473/314 |
| D. 356,133 | 3/1995 | Desmarais | D21/220 |
| 1,250,296 | 12/1917 | Fitzjohn | 473/313 |
| 2,478,468 | 8/1949 | Drake | 473/313 |
| 3,448,981 | 6/1969 | Anweiler | 473/314 |
| 4,702,477 | 10/1987 | Solomon | 473/313 |
| 5,160,141 | 11/1992 | Crews | 473/314 |
| 5,338,029 | 8/1994 | Falzone | D21/220 X |
| 5,382,019 | 1/1995 | Sneed | 473/314 |

FOREIGN PATENT DOCUMENTS

| | | | |
|---|---|---|---|
| 2611510 | 9/1988 | France | 273/77 A |

*Primary Examiner*—Sebastiano Passaniti
*Attorney, Agent, or Firm*—Steven R. Scott

[57] ABSTRACT

An improved design for the hosel and head of golf clubs, including putters, which is primarily characterized by a compound curved hosel that attaches to the club head of golf clubs behind the face, at or near the center of the club head, and slightly above the bottom rear edge of the club head.

29 Claims, 3 Drawing Sheets

GOLF CLUB HEAD AND HOSEL

BACKGROUND

1. Field of the Invention

The instant invention pertains to golf clubs and particularly the design for the head and hosel thereof. More specifically, it discloses a novel hosel/head design for shankless golf clubs with improved driving and putting capabilities.

2. Prior Art in the Field

Golf is an ancient game which continues to generate great interest and levels of participation among a large audience and number of players, both amateur and professional. Not surprisingly, there have been numerous attempts in the past to improve the basic design of golf clubs in ways that improve their driving and/or putting capabilities. Examples of such attempts as they affect hosel/head design may be seen in the following U.S. Patents:

(a) U.S. Pat. No. 1,250,296 issued to E. M. Fitzjohn et al. in 1917 for a "Golf Club."

(b) U.S. Pat. No. 1,703,199 issued to R. E. McClure in 1923 for a "Golf Club."

(c) U.S. Pat. No. 2,478,468 issued to J. F. Drake in 1949 for a "Golf Putter."

(d) U.S. Pat. No. Des. 204,002 issued to T. Tanis et al. in 1966 for a "Golf Putter."

(e) U.S. Pat. No. 3,448,981 issued to D. N. Anweiler in 1969 for a "Golf Club."

(f) U.S. Pat. Nos. Des. 223,766 and Des. 223,767 issued to T. G. Houghtaling in 1972 for a "Golf Club Head or the Like."

(g) U.S. Pat. No. 3,675,923 issued to W. Allen et al. in 1972 for a "Golf Putter with Three Prong Shaft Attachment."

(h) U.S. Pat. No. Des. 235,272 issued to M. E. Quast in 1976 for a "Golf Club Head."

(i) U.S. Pat. No. 3,989,257 issued to S. Barr in 1976 for a "Golf Putter."

(j) U.S. Pat. No. Des. 242,730 issued to C. Pappas in 1976 for a "Golf Putter."

(k) U.S. Pat. No. Des. 248,117 issued to P. Mondy in 1978 for a "Golf Putter Head."

(l) U.S. Pat. No. Des. 248,783 issued to S. Long in 1978 for a "Golf Putterhead."

(m) U.S. Pat. No. 4,163,554 issued to F. Bernhardt in 1979 for a "Golf Putter."

(n) U.S. Pat. No. 4,871,174 issued to M. Kobayashi in 1989 for a "Golf Club."

(o) U.S. Pat. No. 4,951,949 issued to L. Kastenhuber in 1990 for a "Light Weight Split Hosel and Putter Head."

(p) U.S. Pat. No. 4,964,639 issued to R. Tucker in 1990 for a "Golf Putter."

(q) U.S. Pat. No. 5,160,141 issued to D. Crews in 1992 for a "Golf Putter."

(r) U.S. Pat. No. 5,267,733 issued to D. Szokola in 1993 for a "Golf Putter."However, none of the aforesaid anticipate or render obvious the unique and novel teachings of the instant invention as set forth below.

SUMMARY AND OBJECTS OF THE INVENTION

The instant invention is an improved design for the hosel and head of golf clubs, including putters, which (in its preferred embodiments) is characterized by a compound curved hosel that attaches to the club head of golf clubs behind the face, at or near the center of the club head, and slightly above the bottom rear edge of the club head. The first curve of the compound hosel is located in a more or less vertical plane behind the back of the club head and has, at its uppermost end, means for joining same to the shaft of a golf club. The second curve of the compound hosel is located in a more or less horizontal plane behind the bottom edge of the club head. It is joined to the first curve at one of its ends adjacent to the heel of the club head and is joined to the the back of the club head at its other end approximately equidistant between the heel and toe of the club head.

The position of attachment and design of the compound curved hosel and golf club head eliminates the possibility of shanking the ball and imparts substantially more force to the golf ball than conventional putters and irons. It also acts to eliminate pivoting of the club head and face during the strike, virtually eliminating the problems of slicing, fading, drawing and/or hooking experienced by many golfers. In additional to the beneficial effects of the foregoing, these factors result in (i) a substantial expansion of the area on the club face (known to golfers as the "sweet spot") which can effectively be used to strike the ball without slicing, fading, drawing, or hooking; and (ii) improved driving capability. These features substantially improve the game of the golfer utilizing clubs with the improved hosel and head design described herein, improving both accuracy and distance.

DETAILED DESCRIPTION OF PREFERRED EMBODIMENTS

Figure 1:
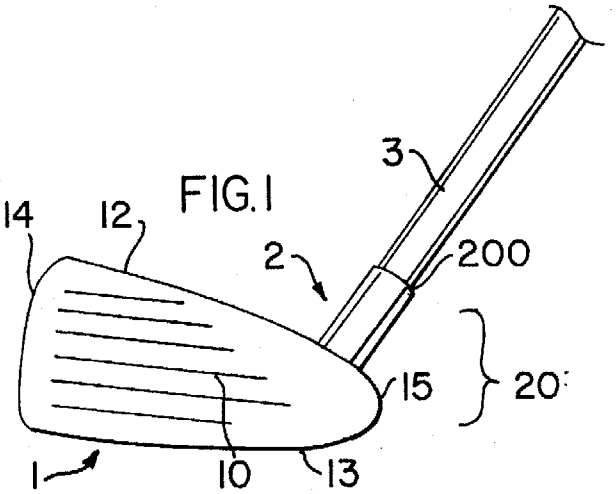
FIG. 1 provides a front or face view of a golf club head and hosel produced in accordance with the teachings of this invention.
Figure 2:
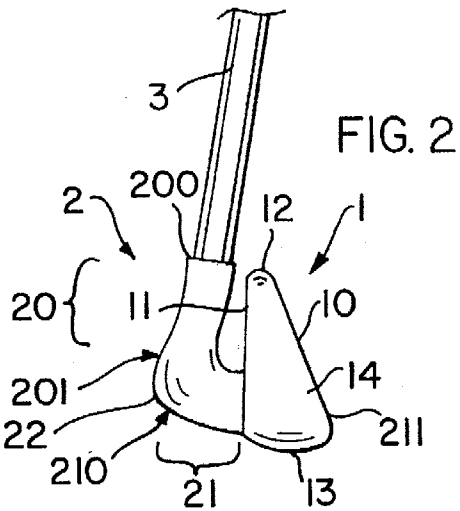
FIG. 2 provides a side view from the toe edge of a golf club head and hosel produced in accordance with the teachings of this invention.
Figure 3:
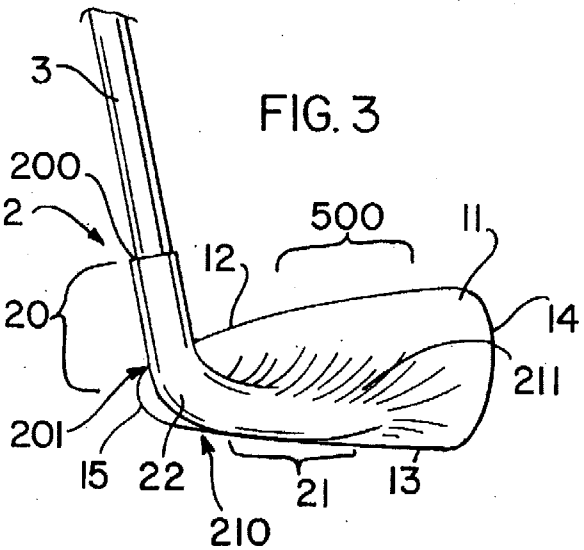
FIG. 3 provides a back view of a golf club head and hosel produced in accordance with the teachings of this invention.
Figure 4:
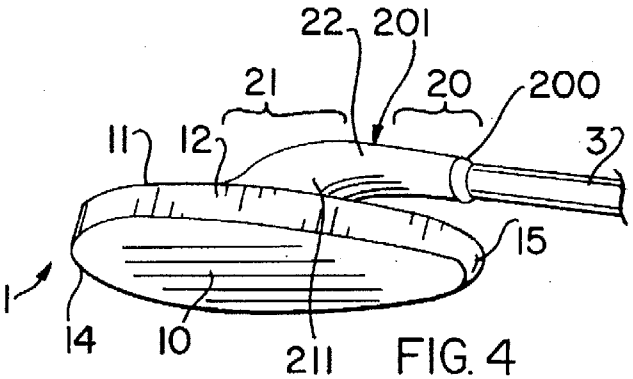
FIG. 4 provides a view from above of a golf club head and hosel produced in accordance with the teachings of this invention.
Figure 7:
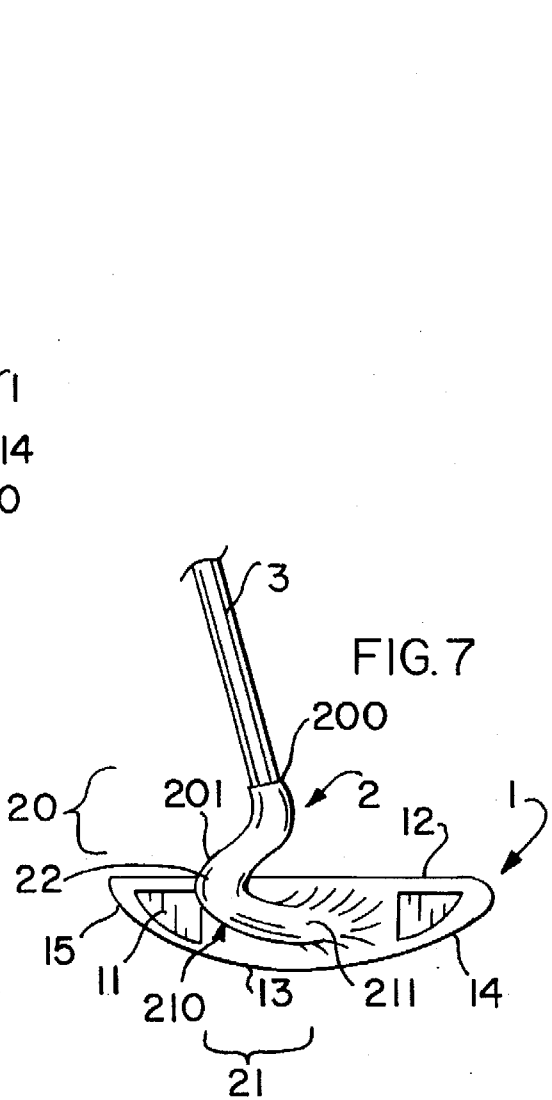
FIG. 7 provides a back view of an alternate embodiment of a golf club head and hosel produced in accordance with the teachings of this invention.
Figure 6:
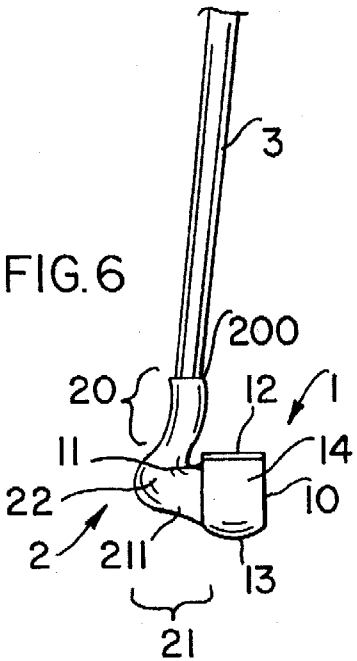
FIG. 6 provides a side view from the toe edge of an alternate embodiment of a golf club head and hosel produced in accordance with the teachings of this invention.

In FIGS. 1 through 7, there will be seen preferred embodiments of golf club heads (indicated generally by arrows 1)

and hosels (indicated generally by arrows 2) for both an iron (FIGS. 1 through 4) and a putter (FIGS. 5 through 7) produced in accordance with the teachings of this invention. As will be noted, the hosels 2 and golf club heads 1 are shown in their typical working position, connected at the end of a linear golf club shaft 3. As is not typical in the art, however, the hosels 2 are attached to the golf club shaft 3 at a position that is generally behind rather than ahead of (and leading) the golf club heads 1. This and other characteristic features of the instant invention will be discussed in more detail below.

Turning first to the golf club head 1, it will be seen that it is characterized by many of the features typical in the art. Thus, it has a first side which serves as the front and striking face 10 of the golf club head 1, and a second side which serves as the back 11 of the golf club head 1. As is further typical of the art, it has a first edge which serves as the top edge 12 of the golf club head 1 and forms the juncture between the face 10 and the back 11 along the top of the golf club head 1, a second edge which serves as the bottom edge 13 of the golf club head 1 and forms the juncture between the face 10 and the back 11 along the bottom of the golf club head 1, a third edge which serves as the toe edge 14 of the golf club head 1 and forms the juncture between the face 10 and the back 11 along the toe edge 14 of the golf club head 1, and a fourth edge which serves as the heel edge 15 of the golf club head 1 and forms the juncture between the face 10 and the back 11 along the heel edge 15 of the golf club head 1.

The hosel 2 and its manner of attachment to the golf club head 1 represents, unlike the golf club head 1, a radical, unique and novel departure from and advance over prior art designs. In its most basic embodiments (not shown) it is comprised of a generally horizontal portion (which is more or less identical to the "generally horizontal portion 21" discussed below in relation to the preferred embodiments) located adjacent to the back of the golf club head and slightly above and generally parallel to its bottom edge, which generally linear portion has a first end adjacent the heel edge that is adapted for connection to the shaft of a golf club handle and a second end more distant therefrom, and is joined to the back of the golf club head (preferably via its second end) intermediate the heel edge and the toe edge (preferably equidistant from each). In the preferred embodiments illustrated it is comprised of: (a) A generally vertical portion (indicated generally and embraced by brace 20) which has a first end 200 adapted for connection to the golf club shaft 3 and has its second end (denoted generally by arrow 201) located adjacent the back 11 of the golf club head 1; (b) a generally horizontal portion (indicated generally and embraced by brace 21) which is generally linear and is located adjacent to the back 11 slightly above and generally parallel to the bottom edge 13, which generally horizontal portion 21 has a first end (denoted generally by arrow 210 and hereinafter referred to as first terminus 210) adjacent the heel edge 15 and a second end (hereinafter referred to as second terminus 211) more distant therefrom, and is joined to the back 11 of the golf club head 1 proximate to the bottom edge 13 and intermediate the heel edge 15 and the toe edge 14; and (c) a connecting portion 22 which is curvilinear, which connecting portion 22 joins the second end 201 of said generally vertical portion 20 to the first terminus 210 of said generally horizontal portion 21. In the preferred embodiments illustrated, however, said generally horizontal portion 21 is curvilinear with its second terminus 211 arcing into the back 11 of club head 1 in an area (indicated generally and embraced by brace 500) that is approximately equidistant from the toe edge 14 and the heel edge 15. As will be noted, area 500 has a preferred width (as indicated by brace 500), wherein the generally horizontal portion 21 contacts and is joined to and along the back 11 of the golf club head 1, that is equal to approximately one half the distance between the heel edge 15 and the toe edge 14.

Figure 5:
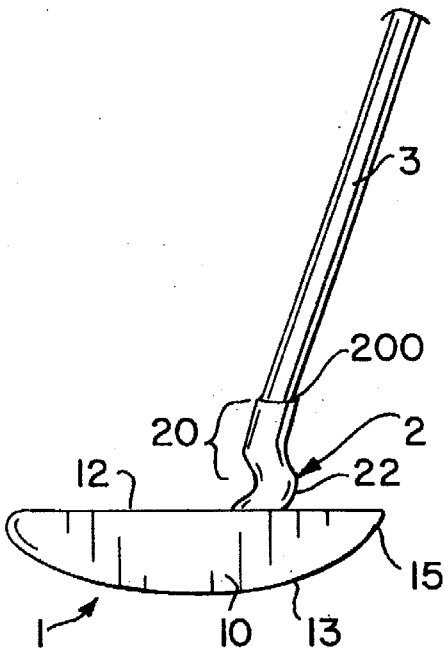
FIG. 5 provides a front or face view of an alternate embodiment of a golf club head and hosel produced in accordance with the teachings of this invention.

The preferred basic configuration for an iron (as shown in FIGS. 1 through 4) produced in accordance with the teachings of this invention may be distinguished from the preferred basic configuration for a putter (as shown in FIGS. 5 though 7) produced in accordance with the teachings of this invention by the location of the first end 200 of the generally vertical portion 20 relative to the heel edge 15. In the preferred embodiment for an iron illustrated in FIGS. 1 through 4 it will be noted that both the first end 200 of the generally vertical portion 20 and the second end 201 of the generally vertical portion 20 are located proximate heel edge 15 rather than toe edge 14. In contrast to this, in the preferred embodiment for a putter illustrated in FIGS. 5 through 7, the first end 200 of the generally vertical portion 20 is located approximately equidistant toe edge 14 and heel edge 15 while the second end 201 of the generally vertical portion 20 continues to be located proximate heel edge 15.

Figure 8:
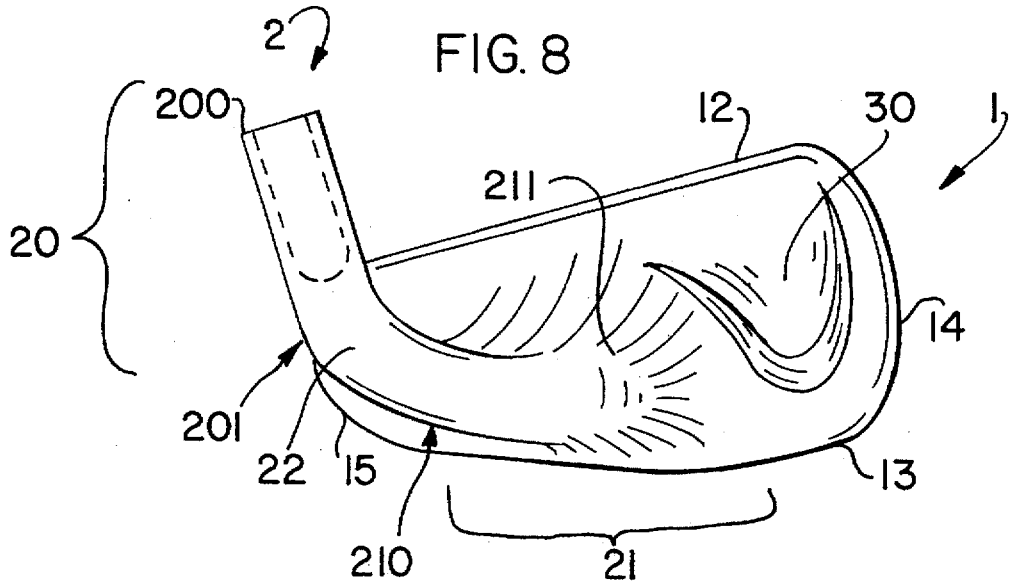
FIG. 8 provides a back view of the preferred embodiment of a golf club head and hosel for a "6 Iron" produced in accordance with the teachings of this invention.
Figure 9:
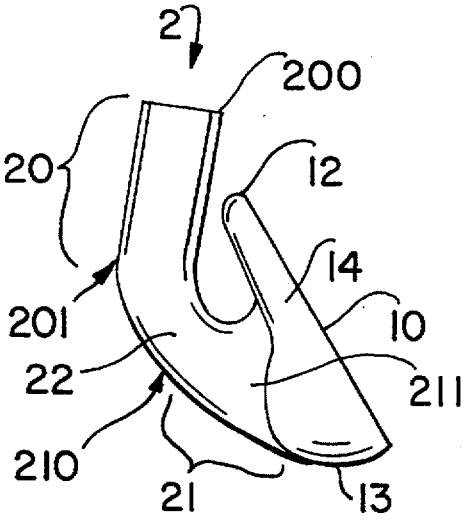
FIG. 9 provides a side view from the toe edge of the preferred embodiment of a golf club head and hosel for a "6 Iron" produced in accordance with the teachings of this invention.
Figure 10:
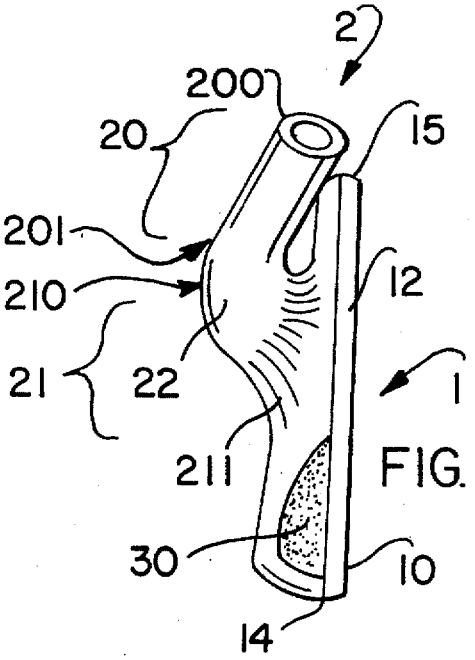
FIG. 10 provides a view from above (with the face at a 0 degree angle relative to the viewer) of the preferred embodiment of a golf club head and hosel for a "6 Iron" produced in accordance with the teachings of this invention.

The previously described characteristics for a hosel 2 and golf club head 1 produced in accordance with the teachings of this invention and additional preferred characteristics may also be observed with reference to the preferred embodiment for a "6 Iron" (which is taken as illustrative of the teachings of this invention as applied to the design and construction of a particular golf club) shown in FIGS. 8 through 10. It should first be noted that the loft and lie of the club heads 1 and hosels 2 illustrated in all drawing figures, as well as of other particular features of club heads and hosels produced in accordance with the teachings of this invention duplicate, except as described herein, those typical for like clubs in the art—i.e.—for a like 6 Iron, 5 Iron, etc. It should also be noted that like numbers and other indicia in the embodiment illustrated in FIGS. 8 through 10 indicate similar or identical features to those described with reference to FIGS. 1 through 7 and will not be further described except to the extent FIGS. 8 through 10 illustrate additional modifications and preferred characteristics. Turning first then to the design of second terminus 211, it will be noted that it is flared so as to blend and merge smoothly with the back 11 of the club head 1 and that the various portions of the hosel 2 likewise blend together in a smooth and even manner. It will further be noted that the emphasis in distribution of the mass of the club head 1 adjacent to the bottom edge 13 is even more pronounced in the embodiment illustrated in FIGS. 8 through 10. Finally, it will be seen that the back 11 is somewhat hollowed out in regions which are not immediately adjacent to the edges thereof, adjusting for the redistribution of weight along the bottom edge 13 and at second terminus 211. (The aforesaid effect is most pronounced and most easily observed in the hollowed region denoted generally by arrow 30). The scope of the inventive concept embodied allows for significant variation in the amount and regions of hollowing.

The improved golf club head and hosel designs taught herein may be produced by any method suitable to the material utilized. Thus, if produced from metal, the designs taught could easily be cast in molds, forged (i.e.-by hammering into the desired profile) or machined from raw stock. Moreover, they may be produced in one or more pieces. These pieces may, likewise, be attached by means suitable for the material in question. Thus, if produced from metal, the club head could be attached to the hosel by numerous methods, such as welding, swageing, brazing, soldering, or possibly by bolts or set screws. Suitable materials for use in their construction may include any suitable for utilization for the production of like items in the art. Thus, they could be formed from numerous materials, including stainless steel, steel, cast iron, beryllium copper, brass, bronze base metal (zinc alloy), titanium, titanium alloys, nickel, nickel alloys or ceramic materials.

The golf club heads and hosels taught herein may, likewise, vary in design significantly without exceeding the scope of the inventive concept set forth in the description and claims. Thus, the golf club heads may be of various dimensions generally referred to in the golf club industry as "standard," "mid-size," or "oversize." Further, the physical silhouette of the club head may vary—i.e.—it may be higher in the toe end and lower at the heel, have a wider base, a narrower top edge, or have other and additional changes made thereto. Moreover, metal can be removed from various areas of the club head to effect a redistribution of weight or the club head can be left without such hollowing or redistribution of weight. These and other changes obvious to those skilled in the art are, therefore, clearly anticipated and comprehended within the inventive concept taught herein.

I claim:

1. A hosel and golf club head for connection to a golf club shaft, comprising:

a golf club head having a front striking face, a back, a top edge, a bottom edge, a toe edge, and a heel edge; and a hosel comprised of:

a generally horizontal portion, which generally horizontal portion is located adjacent to the bottom edge on the back side so as to be generally parallel to the bottom edge, has a first shaft connection end adjacent the heel edge which is adapted for connection to a golf club shaft and a second end more distant therefrom, and is joined to the back of the golf club head proximate to the bottom edge and intermediate the heel edge and the toe edge at said second end.

2. A hosel and golf club head for connection to a golf club shaft, comprising:

a golf club head having a front striking face, a back, a top edge, a bottom edge, a toe edge, and a heel edge; and a hosel comprised of:

a generally vertical portion, which generally vertical portion is adapted for connection at a first shaft connection end to a golf club shaft and has a second end located adjacent the back side of the golf club head;

a generally horizontal portion, which generally horizontal portion is located adjacent to the bottom edge on the back side so as to be generally parallel to the bottom edge, has a first end adjacent the heel edge and a second end more distant therefrom, and is joined to the back of the golf club head proximate to the bottom edge and intermediate the heel edge and the toe edge at said second end; and a connecting portion, which connecting portion joins the second end of said generally vertical portion to the first end of said generally horizontal portion.

3. A hosel and golf club head for connection to a golf club shaft as described in claim 1, wherein said generally horizontal portion is curvilinear.

4. A hosel and golf club head for connection to a golf club shaft as described in claim 2, wherein said generally horizontal portion is curvilinear.

5. A hosel and golf club head for connection to a golf club shaft as described in claims 1, 2, 3 or 4, wherein said generally horizontal portion is joined to the back of the golf club head approximately equidistant from the toe edge and the heel edge.

6. A hosel and golf club head for connection to a golf club shaft as described in claim 5, wherein the generally horizontal portion contacts and is joined to and along the back of the golf club head for a distance that is equal to approximately one half the distance between the heel edge and the toe edge.

7. A hosel and golf club head for connection to a golf club shaft as described in claim 5, wherein said shaft connection end is located proximate the heel edge.

8. A hosel and golf club head for connection to a golf club shaft as described in claim 6, wherein said shaft connection end is located proximate the heel edge.

9. A hosel and golf club head for connection to a golf club shaft as described in claims 1, 2, 3 or 4, wherein the generally horizontal portion contacts and is joined to and along the back of the golf club head for a distance that is equal to approximately one half the distance between the heel edge and the toe edge.

10. A hosel and golf club head for connection to a golf club shaft as described in claim 9, wherein said shaft connection end is located proximate the heel edge.

11. A hosel and golf club head for connection to a golf club shaft as described in claims 1, 2, 3 or 4, wherein said shaft connection end is located proximate the heel edge.

12. A hosel and golf club head for connection to a golf club shaft as described in claims 2 or 4, wherein the first end of the generally vertical portion is located approximately equidistant the toe edge and the heel edge.

13. A hosel and golf club head for connection to a golf club shaft as described in claim 12 wherein said generally horizontal portion is curvilinear and the first end of the generally vertical portion is located approximately equidistant the toe edge and the heel edge.

14. A hosel and golf club head for connection to a golf club shaft as described in claim 13, wherein said generally horizontal portion is joined to the back of the golf club head at its second end and the first end of the generally vertical portion is located approximately equidistant the toe edge and the heel edge.

15. A hosel and golf club head for connection to a golf club shaft as described in claim 14, wherein said generally horizontal portion is joined to the back of the golf club head approximately equidistant from the toe edge and the heel edge and the first end of the generally vertical portion is located approximately equidistant the toe edge and the heel edge.

16. A hosel and golf club head for connection to a golf club shaft as described in claim 15, wherein the generally horizontal portion contacts and is joined to and along the back of the golf club head for a distance that is equal to approximately one half the distance between the heel edge and the toe edge and the first end of the generally vertical portion is located approximately equidistant the toe edge and the heel edge.

17. A hosel and golf club head for connection to a golf club shaft as described in claim 14, wherein the generally horizontal portion contacts and is joined to and along the back of the golf club head for a distance that is equal to approximately one half the distance between the heel edge and the toe edge and the first end of the generally vertical portion is located approximately equidistant the toe edge and the heel edge.

18. A hosel and golf club head for connection to a golf club shaft as described in claim 13, wherein said generally horizontal portion is joined to the back of the golf club head approximately equidistant from the toe edge and the heel edge and the first end of the generally vertical portion is located approximately equidistant the toe edge and the heel edge.

19. A hosel and golf club head for connection to a golf club shaft as described in claim 18, wherein the generally horizontal portion contacts and is joined to and along the back of the golf club head for a distance that is equal to approximately one half the distance between the heel edge and the toe edge and the first end of the generally vertical portion is located approximately equidistant the toe edge and the heel edge.

20. A hosel and golf club head for connection to a golf club shaft as described in claim 13, wherein the generally horizontal portion contacts and is joined to and along the back of the golf club head for a distance that is equal to approximately one half the distance between the heel edge and the toe edge and the first end of the generally vertical portion is located approximately equidistant the toe edge and the heel edge.

21. A hosel and golf club head for connection to a golf club shaft as described in claim 20, wherein said generally horizontal portion is joined to the back of the golf club head at its second end and the first end of the generally vertical portion is located approximately equidistant the toe edge and the heel edge.

22. A hosel and golf club head for connection to a golf club shaft as described in claim 21, wherein said generally horizontal portion is joined to the back of the golf club head approximately equidistant from the toe edge and the heel edge and the first end of the generally vertical portion is located approximately equidistant the toe edge and the heel edge.

23. A hosel and golf club head for connection to a golf club shaft as described in claim 22, wherein the generally horizontal portion contacts and is joined to and along the back of the golf club head for a distance that is equal to approximately one half the distance between the heel edge and the toe edge and the first end of the generally vertical portion is located approximately equidistant the toe edge and the heel edge.

24. A hosel and golf club head for connection to a golf club shaft as described in claim 21, wherein the generally horizontal portion contacts and is joined to and along the back of the golf club head for a distance that is equal to approximately one half the distance between the heel edge and the toe edge and the first end of the generally vertical portion is located approximately equidistant the toe edge and the heel edge.

25. A hosel and golf club head for connection to a golf club shaft as described in claim 12, wherein said generally horizontal portion is joined to the back of the golf club head approximately equidistant from the toe edge and the heel edge and the first end of the generally vertical portion is located approximately equidistant the toe edge and the heel edge.

26. A hosel and golf club head for connection to a golf club shaft as described in claim 25, wherein the generally horizontal portion contacts and is joined to and along the back of the golf club head for a distance that is equal to approximately one half the distance between the heel edge and the toe edge and the first end of the generally vertical portion is located approximately equidistant the toe edge and the heel edge.

27. A hosel and golf club head for connection to a golf club shaft as described in claim 12, wherein the generally horizontal portion contacts and is joined to and along the back of the golf club head for a distance that is equal to approximately one half the distance between the heel edge and the toe edge and the first end of the generally vertical portion is located approximately equidistant the toe edge and the heel edge.

28. A hosel and golf club head for connection to a golf club shaft, comprising:

A golf club head having a front striking face, a back, a top edge, a bottom edge, a toe edge, and a heel edge; and a hosel comprised of:

a first curvilinear portion located in a generally horizontal plane adjacent the bottom edge at the back of the golf club, which first curvilinear portion has a first end adjacent the heel edge and a second end joined to the back of the golf club head intermediate the heel edge and toe edge thereof; and a second curvilinear portion located in a generally vertical plane adjacent the back of the golf club head having a first end adapted for connection to the shaft of a golf club and a second end connected to the first end of the first curvilinear portion.

29. A hosel and golf club head for connection to a golf club shaft as described in claims 1, 2 or 28, wherein the thickness of the golf club head is greatest where it is joined to the generally horizontal portion of the hosel, adjacent to where it is joined to the generally horizontal portion of the hosel, and adjacent to and along the edges of the golf club head, the thickness of the golf club head being defined as the distance between the first side and the second side thereof.

* * * * *